US011414775B1

(12) United States Patent
Iou et al.

(10) Patent No.: US 11,414,775 B1
(45) Date of Patent: Aug. 16, 2022

(54) POWER SUPPLY SYSTEM FOR A VERTICAL CONTINUOUS ELECTROPLATING FRAME

(71) Applicant: U-PRO MACHINES CO., LTD., Taoyuan (TW)

(72) Inventors: Hsin-Chi Iou, Taoyuan (TW); Huan-Chun Lin, Taoyuan (TW); Hsu-Cheng Peng, Taoyuan (TW)

(73) Assignee: U-Pro Machines Co., Ltd., Taoyuan (TW)

( * ) Notice: Subject to any disclaimer, the term of this patent is extended or adjusted under 35 U.S.C. 154(b) by 0 days.

(21) Appl. No.: 17/319,330

(22) Filed: May 13, 2021

(51) Int. Cl.
*C25D 17/08* (2006.01)

(52) U.S. Cl.
CPC ..... *C25D 17/08* (2013.01)

(58) Field of Classification Search
CPC ..... C25D 17/08; H01L 21/67712; H01L 21/67369
USPC ..... 204/297.14
See application file for complete search history.

(56) References Cited

FOREIGN PATENT DOCUMENTS

JP 2006009060 A * 1/2006

OTHER PUBLICATIONS

Kitamura, Machine Translation, JP 2006-009060 A (Year: 2006).*

* cited by examiner

*Primary Examiner* — Harry D Wilkins, III
*Assistant Examiner* — Ho-Sung Chung
(74) *Attorney, Agent, or Firm* — Rosenberg, Klein & Lee

(57) ABSTRACT

A power supply system for a vertical continuous electroplating frame, comprising: a power supply rail arranged on the vertical continuous electroplating device; and an electrode case, arranged a case body on the top surface of the electroplating frame, inside the case body having an electrode plate corresponding to the power supply rail, at the bottom of the electrode plate having an elastic unit, the top surface of the case body having a positioning groove corresponding to the electrode plate, when the electrode plate is electrical contacted with the power supply rail, the electroplating current is provided to the object to be plated through the electroplating frame.

7 Claims, 3 Drawing Sheets

POWER SUPPLY SYSTEM FOR A VERTICAL CONTINUOUS ELECTROPLATING FRAME

BACKGROUND OF THE INVENTION

1. Field of the Invention

The invention relates to a power supply system for a vertical continuous electroplating frame, especially to one that can provide a stable plating current to the object to be plated.

2. Description of the Related Art

The Vertical Continuous Plating equipment can fix the object to be plated (such as a printed circuit board) vertically on the electroplating frame, and use the conveying device to make the object to be plated continuously move along with the electroplating frame in the electroplating tank, while supplying power to the electroplating frame to electroplate the object to be plated; Moreover, the conventional electroplating frame power supply method is to set a power supply rail on the vertical continuous electroplating equipment, and make the electroplating frame form a conductive groove relative to the power supply rail, and let the electroplating frame use the conductive groove to electrical contact with the power supply rail to provide electroplating current to the object to be plated, so as to electroplate the object; however, the conveyance of the electroplating frame is usually not very smooth throughout the process of electroplating, resulting in the electrical contact of the conductive groove and the power supply rail sometimes may only be a point contact or even an open circuit, resulting in unstable electroplating current provided to the object to be plated, thereby affecting the electroplating quality of the object to be plated.

SUMMARY OF THE INVENTION

It is a primary objective of the present invention to provide a damping unit with simple mechanism and no wear and tear problem, and the damping unit is used in a resistance device, which will have the functions of linear adjustment of the training load and convenient operation and control.

In order to achieve the above objectives, one of the technical means of the present invention including: a power supply system for a vertical continuous electroplating frame, comprising: a power supply rail arranged on the vertical continuous electroplating device; and an electrode case, arranged a case body on the top surface of the electroplating frame, inside the case body having an electrode plate corresponding to the power supply rail, at the bottom of the electrode plate having an elastic unit, the top surface of the case body having a positioning groove corresponding to the electrode plate, when the electrode plate is electrical contacted with the power supply rail, the electroplating current is provided to the object to be plated through the electroplating frame. Wherein the electrode plate is horizontally arranged relatively to the direction of the power supply rail; A positioning rail is arranged at the bottom edge of the top part of the C shape structure by the power supply rail, the inner height of the C shape structure is corresponding to the arrangement height of the electrode case, and at the top edge of the bottom part of the C shape structure has a wear-resistant rail; The power supply rail has a positioning rail arranged at the bottom edge of the top part of the C shape structure, then has a pressing rail corresponding to the positioning rail, and the positioning rail and the pressing rail has an elastic unit, so the pressing rail and the electrode plate is electrical contacted.

Another one of the technical means of the present invention including: a power supply system for a vertical continuous electroplating frame, comprising: a power supply rail, arrange a positioning rail on the vertical continuous electroplating device, arrange a pressing rail corresponding to the positioning rail, and arrange an elastic unit between the positioning rail and the pressing rail; an electrode case, arranged a case body on the top surface of the electroplating frame, inside the case body having an electrode plate corresponding to the pressing rail of the power supply rail, the top surface of the case body having a positioning groove corresponding to the electrode plate, when the electrode plate is electrical contacted with the pressing rail, the electroplating current is provided to the object to be plated through the electroplating frame; Wherein the electrode plate is horizontally arranged relatively to the direction of the power supply rail; wherein a positioning rail of the power supply rail is arranged at the bottom edge of the top part of the C shape structure by the power supply rail, the inner height of the C shape structure is corresponding to the arrangement height of the electrode case, and at the top edge of the bottom part of the C shape structure has a wear-resistant rail.

Whereby the bottom of the electrode plate is provided with an elastic unit or let the power supply rail include a positioning rail and a pressing rail, and an elastic unit is provided between the positioning rail and the pressing rail, so let the electroplating frame keep having continuously electrical contacted between the electrode plate and the power supply rail/pressing rail, even in the situation that electroplating frame has unsmooth conveying.

DETAILED DESCRIPTION OF THE PREFERRED EMBODIMENT

Figure 1:
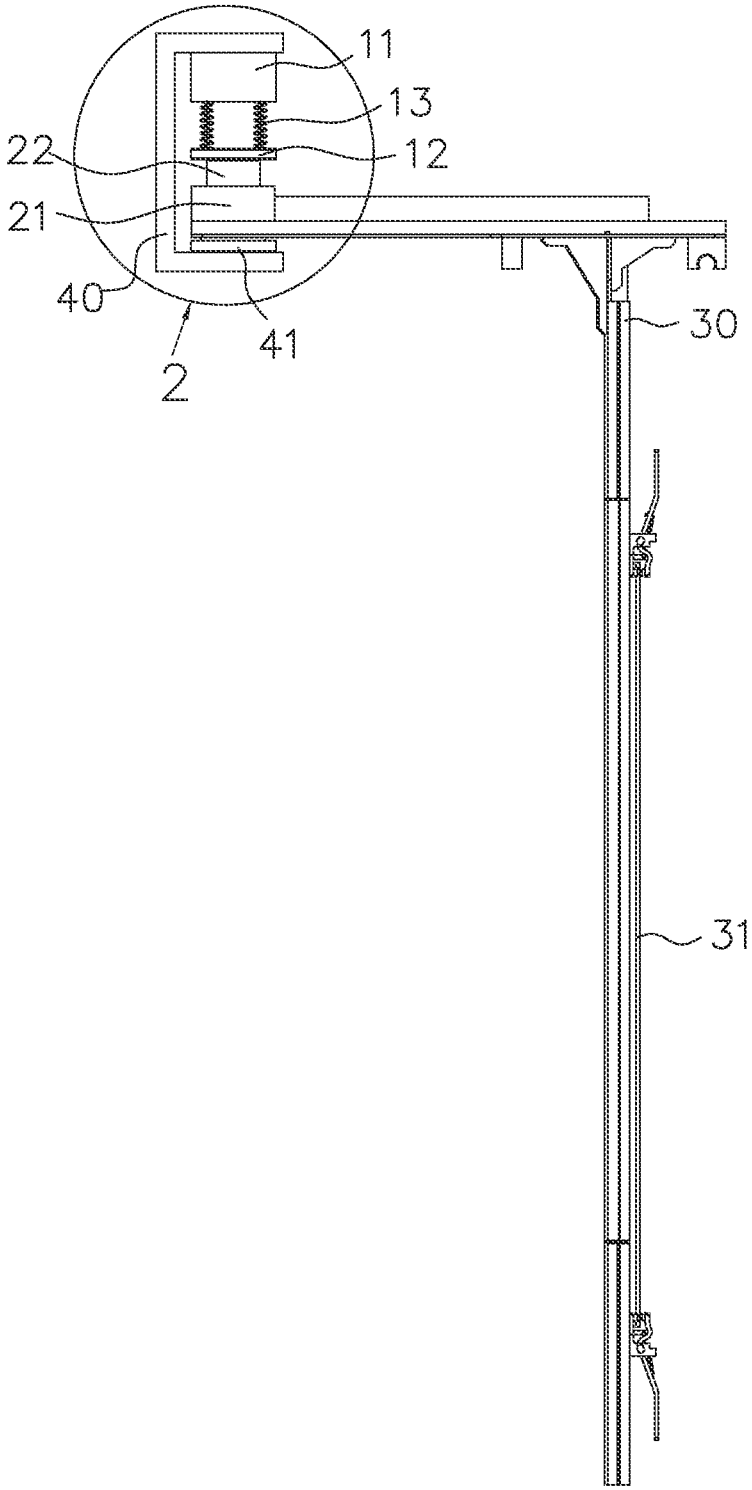
FIG. 1 is a schematic diagram illustrating the structure of the present invention.
Figure 2:
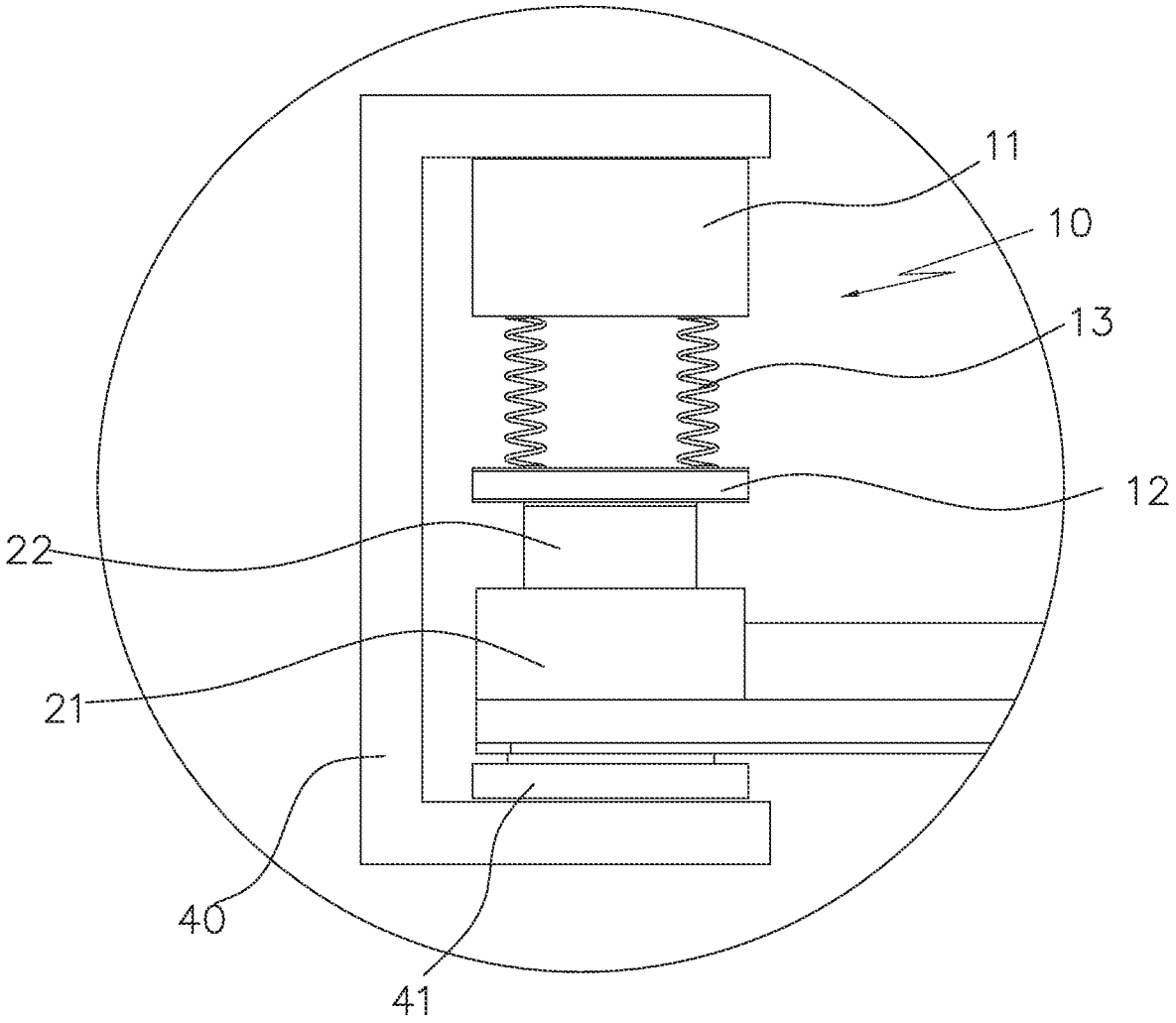
FIG. 2 is a zoom-in of the 2 in the FIG. 1.
Figure 3:
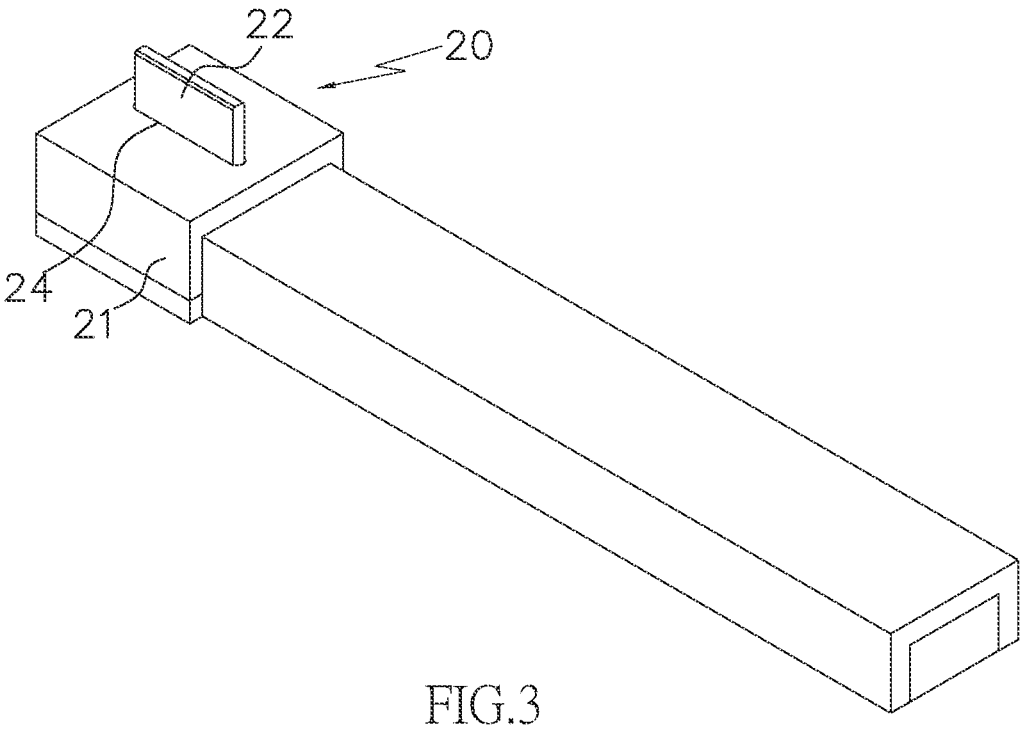
FIG. 3 is a perspective view of the electrode case of the present invention.
Figure 4:
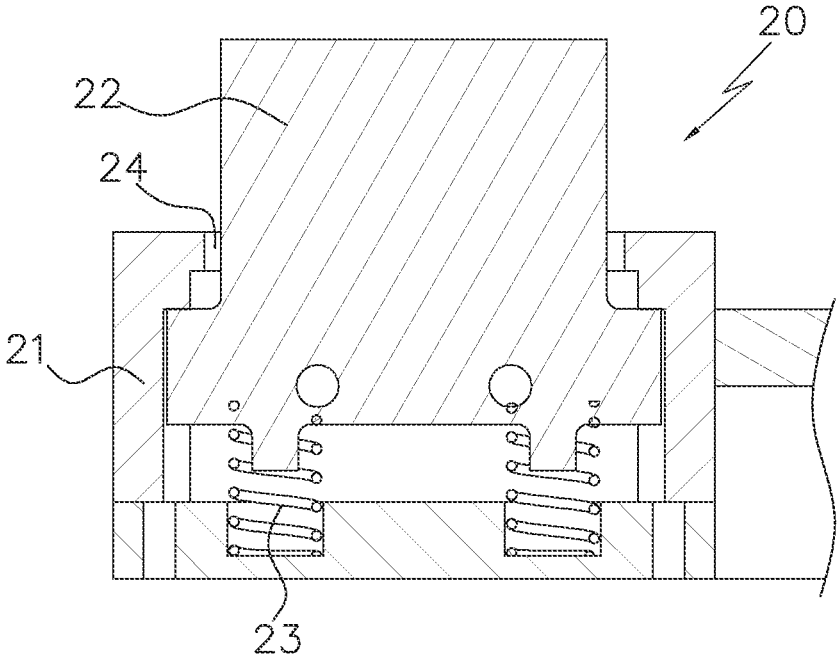
FIG. 4 is a sectional view of the electrode case of the present invention.

First, referring to FIG. 1-4, the first embodiment of the present invention including: a power supply rail 10 arranged on the vertical continuous electroplating device; and an electrode case 20, arranged a case body 21 on the top surface of the electroplating frame 30, inside the case body 21 having an electrode plate 22 corresponding to the power supply rail 10, the electrode plate 22 is horizontally arranged relatively to the direction of the power supply rail 10, at the bottom of the electrode plate 22 having an elastic unit 23, the top surface of the case body 21 having a positioning groove 24 corresponding to the electrode plate 22, when the electrode plate 22 is electrical contacted with the power supply rail 10, the electroplating current is provided to the object 31 to be plated through the electroplating frame 30.

The second embodiment of the present invention including: a power supply rail 10, arrange a positioning rail 11 on the vertical continuous electroplating device, arrange a pressing rail 12 corresponding to the positioning rail 11, and arrange an elastic unit 13 between the positioning rail 11 and the pressing rail 12; an electrode case 20, arranged a case body 21 on the top surface of the electroplating frame 30, inside the case body 21 having an electrode plate 22 corresponding to the pressing rail 12 of the power supply rail 10, the electrode plate 22 is horizontally arranged relatively to the direction of the power supply rail 10, the top surface of the case body 21 having a positioning groove 24 corresponding to the electrode plate 22, when the electrode plate 22 is electrical contacted with the pressing rail 12, the electroplating current is provided to the object 31 to be plated through the electroplating frame 30.

The third embodiment of the present invention including: a power supply rail 10, arrange a positioning rail 11 on the vertical continuous electroplating device, arrange a pressing rail 12 corresponding to the positioning rail 11, and arrange an elastic unit 13 between the positioning rail 11 and the pressing rail 12; an electrode case 20, arranged a case body 21 on the top surface of the electroplating frame 30, inside the case body 21 having an electrode plate 22 corresponding to the power supply rail 10, the electrode plate 22 is horizontally arranged relatively to the direction of the power supply rail 10, the bottom of the electrode plate 22 has an elastic unit 23, the top surface of the case body 21 having a positioning groove 24 corresponding to the electrode plate 22, when the electrode plate 22 is electrical contacted with the pressing rail 12, the electroplating current is provided to the object 31 to be plated through the electroplating frame 30.

Also, the above-mentioned second and third embodiments can also enable the power supply rail 10 to set the positioning rail 11 on the bottom edge of the top of a C shape structure 40 of the vertical continuous electroplating equipment, and the inner height of the C shape structure 40 is corresponding with the setting height of the electrode case 20, and a wear-resistant rail 41 is provided on the top edge of the bottom of the C shape structure 40.

With the feature disclosed above, in the first embodiment, the bottom of the electrode plate 22 is provided with an elastic unit 23; in the second embodiment, let the power supply rail 10 include a positioning rail 11 and a pressing rail 12, and an elastic unit 13 is provided between the positioning rail 11 and the pressing rail 12; in the third embodiment, the bottom of the electrode plate 22 is provided with an elastic unit 23, the power supply rail 10 include a positioning rail 11 and a pressing rail 12, and an elastic unit 13 is provided between the positioning rail 11 and the pressing rail 12; whereby let the electroplating frame 30 keep having continuously electrical contacted between the electrode plate 22 and the power supply rail 10/pressing rail 12, even in the situation that electroplating frame 30 has unsmooth conveying.

Although particular embodiments of the invention have been described in detail for purposes of illustration, various modifications and enhancements may be made without departing from the spirit and scope of the invention. Accordingly, the invention is not limited except as by the appended claims.

What is claimed is:

1. A power supply system for a vertical continuous electroplating frame, comprising:

a power supply rail extending in a horizontal direction arranged on the vertical continuous electroplating frame; and an electrode case having a case body on a top of the vertical continuous electroplating frame, inside the case body having an electrode plate corresponding to the power supply rail, at a bottom of the electrode plate having an elastic unit, a top surface of the case body having a positioning groove corresponding to the electrode plate, when the electrode plate is electrical contacted with the power supply rail, an electroplating current is provided to an object to be plated through the vertical continuous electroplating frame.

2. The power supply system for a vertical continuous electroplating frame as claimed in claim 1, wherein the electrode plate extends in a vertical direction with respect to the horizontal direction of the power supply rail.

3. The power supply system for a vertical continuous electroplating frame as claimed in claim 2, wherein the power supply rail is arranged at a bottom edge of a top part of a C shape structure, an inner height of the C shape structure is corresponding to an arrangement height of the electrode case, and at atop edge of a bottom part of the C shape structure has a wear-resistant rail.

4. The power supply system for a vertical continuous electroplating frame as claimed in claim 3, wherein the power supply rail has a positioning rail arranged at the bottom edge of the top part of the C shape structure, then has a pressing rail corresponding to the positioning rail, and the positioning rail and the pressing rail has an elastic unit, so the pressing rail and the electrode plate is electrical contacted.

5. A power supply system for a vertical continuous electroplating frame, comprising:

a power supply rail extending in a horizontal direction, arrange a positioning rail on the vertical continuous electroplating frame, arrange a pressing rail corresponding to the positioning rail, and arrange an elastic unit between the positioning rail and the pressing rail; and an electrode case having a case body on a top of the vertical continuous electroplating frame, inside the case body having an electrode plate corresponding to the pressing rail of the power supply rail, atop surface of the case body having a positioning groove corresponding to the electrode plate, when the electrode plate is electrical contacted with the pressing rail, an electroplating current is provided to an object to be plated through the vertical continuous electroplating frame.

6. The power supply system for a vertical continuous electroplating frame as claimed in claim 5, wherein the electrode plate extends in a vertical direction with respect to the horizontal direction of the power supply rail.

7. The power supply system for a vertical continuous electroplating frame as claimed in claim 6, wherein a positioning rail of the power supply rail is arranged at a bottom edge of a top part of a C shape structure by the power supply rail, an inner height of the C shape structure is corresponding to an arrangement height of the electrode case, and at a top edge of a bottom part of the C shape structure has a wear-resistant rail.

* * * * *